US005086295A

United States Patent [19]

Boettcher et al.

[11] Patent Number: 5,086,295

[45] Date of Patent: Feb. 4, 1992

[54] APPARATUS FOR INCREASING COLOR AND SPATIAL RESOLUTIONS OF A RASTER GRAPHICS SYSTEM

[76] Inventors: Eric R. Boettcher, 366 W. Olive #5, Sunnyvale, Calif. 94086; David R. Barker, 400 E. Remmington Dr. #236, Sunnyvale, Calif. 94087

[21] Appl. No.: 143,740

[22] Filed: Jan. 12, 1988

[51] Int. Cl.[5] ..... G09G 5/04

[52] U.S. Cl. ..... 340/701; 340/703

[58] Field of Search ..... 340/703, 701, 799, 798, 340/724, 728, 745

[56] References Cited

U.S. PATENT DOCUMENTS

| | | | |
|---|---|---|---|
| 4,580,135 | 4/1986 | Kummer et al. . | |
| 4,591,842 | 5/1986 | Clarke, Jr. et al. . | |
| 4,595,917 | 6/1986 | McCallister et al. . | |
| 4,641,262 | 2/1987 | Bryan et al. | 340/745 |
| 4,647,923 | 3/1987 | Carleton, Jr. . | |
| 4,772,851 | 9/1988 | Hannah | 340/703 |
| 4,808,989 | 2/1988 | Tabata et al. | 340/703 |

FOREIGN PATENT DOCUMENTS

| | | | |
|---|---|---|---|
| 1200031 | 2/1986 | Canada | 340/703 |
| WO86/05911 | 10/1986 | PCT Int'l Appl. . | |
| 2140811 | 4/1985 | United Kingdom . | |
| 2167926 | 6/1986 | United Kingdom | 340/703 |

*Primary Examiner*—Alvin E. Oberley
*Assistant Examiner*—Richard Hjerpe
*Attorney, Agent, or Firm*—Klarquist, Sparkman, Campbell, Leigh & Whinston

[57] ABSTRACT

Apparatus for increasing the color and spatial resolutions of existing raster graphics systems by reformatting the output word transmitted to the system display device. For increasing the color resolution, two consecutive outputs of a graphics adapter in the system are grouped into a reformatted output that contains a greater number of bits. The reformatted output forms the address to a color mapping RAM with multiple palettes. Switch commands may be inserted within the display data to dynamically select between the original and reformatted outputs and among the active color palettes of the RAM, if desired. For increased spatial resolution, the original adapter output is divided into multiple reformatted outputs. A multiplexer alternately selects these multiple outputs at twice the rate that the graphics adapter produces its original output. The multiple outputs generate two different color signals for a single pixel location to double the horizontal spatial resolution.

25 Claims, 3 Drawing Sheets

APPARATUS FOR INCREASING COLOR AND SPATIAL RESOLUTIONS OF A RASTER GRAPHICS SYSTEM

BACKGROUND OF THE INVENTION

This invention relates generally to raster graphics systems and more particularly to apparatus for increasing the color and spatial resolutions of an existing system by reformatting the output transmitted to the system display device.

Raster graphics systems have in recent years become the preferred form of producing graphic images on a computer display device. Such systems generally comprise a host computer, a graphics controller, and a cathode ray tube (CRT) display device. In personal computer-based systems, the graphics controller is often contained on a plug-in card known as a graphics adapter. To generate graphics, display data from the host computer is passed to the graphics controller, which controls the data displayed. The display data is stored in bit planes within memory, with each bit in a plane corresponding to a picture element, or pixel, located on the display device screen. Several bit planes may be "stacked" one upon another so that each pixel location has as many associated bits as there are planes in the stack. For example, 4-bit planes provide a 4-bit pixel output that can produce up to 16 simultaneously displayable colors or 16 shades of gray on the system display device. The output from these planes typically forms the address to a number of internal registers whose data provides the color settings for the display. The group, or palette, of colors within the registers can be changed by a microprocessor (CPU) that controls the adapter. But the number of bits addressing the palette limits the number of colors that can be simultaneously displayed.

This limited color resolution is a major drawback of present raster graphics systems for personal computers. Color resolution may be defined as the number of pixel colors that can be simultaneously displayed and is a function of the bits per pixel output to the display device. For example, a system such as the IBM PC with a Color/Graphics Monitor Adapter (CGA) or Enhanced Graphics Adapter (EGA) produces four bits per pixel. This output can only provide 16 simultaneously displayable colors, with access to other palettes required for more colors. So few colors often do not produce a realistic image.

Another drawback of present personal computer-based raster graphics systems is their limited spatial resolution. Spatial resolution may be defined as the number of pixels that can be displayed on the display device screen and is given as horizontal and vertical quantities, i.e., 480 by 200. The greatest spatial resolution of the IBM PC with an EGA card is no better than 640 by 350 pixels. This spatial resolution is too low for high quality desk top publishing and high column spread sheets.

A third drawback inherent in present systems is the limited number of colors in the color palette. In the EGA, for example, a 4-bit output from the graphics controller addresses one of 16 palette registers internal to the EGA's circuitry. The content of each of these registers corresponds to a displayable color, with six bits from the register driving the display device. A 6-bit register can produce only 64 possible colors.

SUMMARY OF THE INVENTION

An object of the invention, therefore, is to increase the color and spatial resolutions provided by existing raster graphics systems.

Another object of the invention is to increase the resolutions by reformatting the output of the graphics adapter while maintaining the original output separately so that either the increased or the original resolution may be selected.

A third object of the invention is t enable the display data to select dynamically between a high color and a high spatial resolution for objects that appear simultaneously in a displayed image.

A fourth object of the invention is to enable the data to select dynamically color palettes so that multiple palettes can be displayed simultaneously in a displayed image, for example, to color multiple objects individually.

To achieve these objects, an apparatus according to the invention includes means for reformatting the original output word of the adapter into a second, reformatted output word. Both the original and reformatted output words are available for selection via means such as a multiplexer circuit.

In a first embodiment of the apparatus, the formatting means comprises a number of latching circuits that are adapted to group consecutive words of adapter output into the reformatted output word to increase the color resolution. The reformatted output word is wider than the original output word and can thus address a larger color palette. The grouping or "stacking" of consecutive output words, however, decreases the horizontal spatial resolution of the data displayed. The color palette is contained within a color mapping RAM that includes a number of palettes which can be individually selected for the adapter output word. Both the selection between the original and reformatted output words and the active color palette may be done dynamically with switch commands inserted within the display data. These switch commands enable the simultaneous display of objects with different colors and with different resolutions within a single displayed image.

In a second embodiment of the apparatus, the "stacking" of adapter outputs is extended to four consecutive output words. This option provides over 4,000 times the color resolution of the original adapter output word while reducing the spatial resolution by a factor of 4. The reformatted output word is 16 bits in width and provides the color signal itself without the need for a color mapping RAM.

In a third embodiment, each original output word of the adapter pixel is reformatted into two narrower words by dividing the original output word in half. This effectively doubles the horizontal spatial resolution by replacing a single pixel with two pixels.

The foregoing and other objects, features, and advantages of the invention will become more apparent from the following detailed description of the preferred embodiments which proceeds with reference to the accompanying drawings.

DETAILED DESCRIPTION

Figure 1:
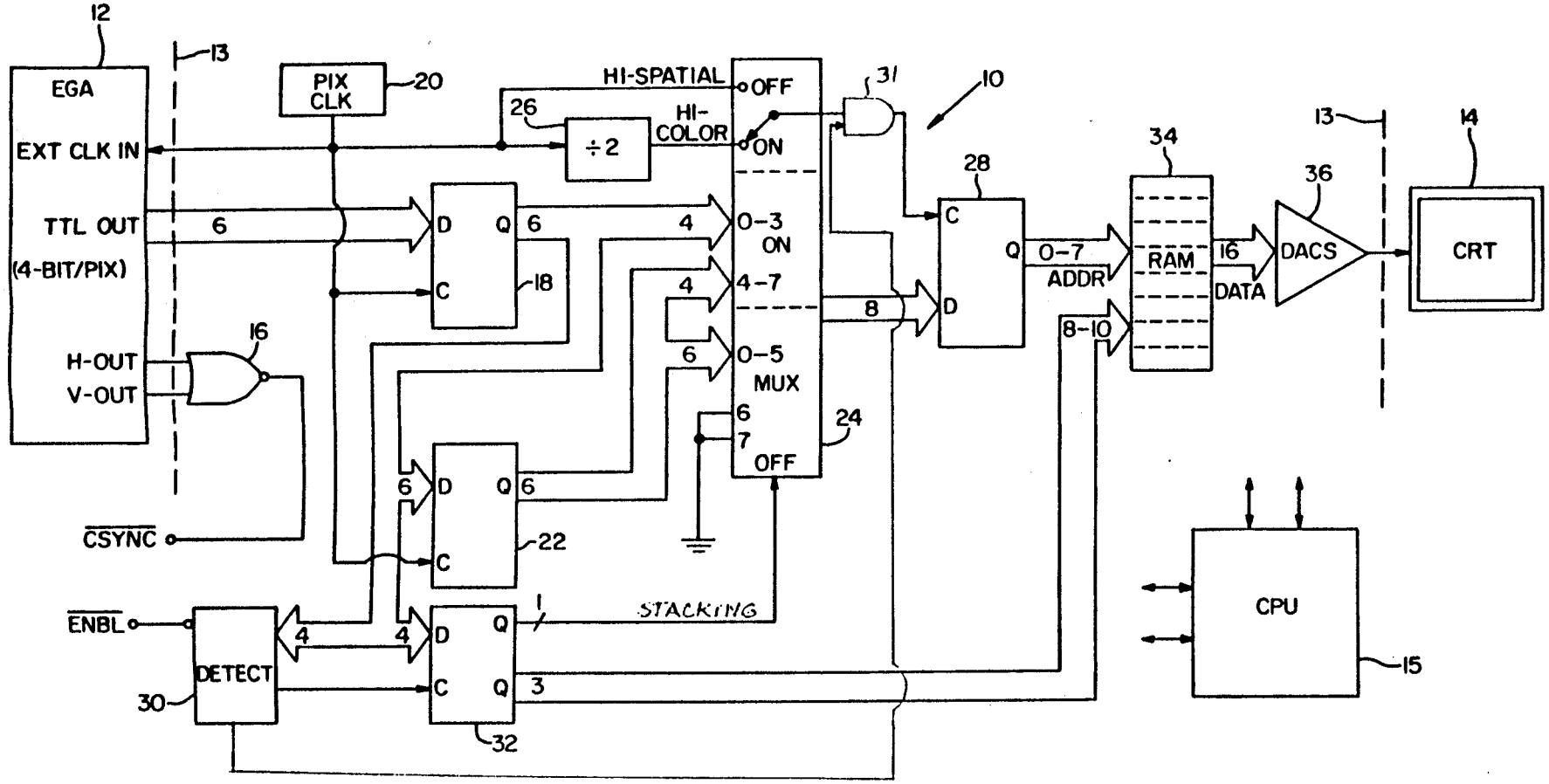
FIG. 1 is a functional block diagram of an apparatus according to the invention for increasing the color resolution of an existing raster graphics system.

Referring now to FIG. 1 of the drawings, there is shown a functional block diagram of an apparatus 10 according to the invention, comprising the blocks between the parallel dashed lines 13. The apparatus 10 provides increased color resolution to a raster graphics system that includes a personal computer (not shown), a graphics adapter 12, and a CRT display device 14. The adapter 12 may be one of a number of a graphics plug-in cards such as a CGA, EGA, Hercules, or built-in adapters such as the Multicolor Graphics Array (MCGA) and Video Graphics Array (VGA). In the present embodiment, an EGA card is illustrated with its 9-pin output, including ground, vertical and horizontal retracing signals V-OUT and H-OUT, and a 6-bit output word that determines the color of each pixel. The output word is generated by one of the 16 palette registers internal to the EGA. The registers, in turn, are addressed by a 4-bit wide EGA display memory data word. This 4-bit word has only 16 possible combinations to address one of the 16 registers, and hence the adapter 12 is limited to a palette of 16 simultaneously displayable colors out of a total of 64 colors.

The apparatus 10 handles the ground and retracing signals V-OUT and H-OUT in a conventional manner as known in the art. Ground is provided in the apparatus output to the display device. The retracing signals are logically combined into a composite sync signal $\overline{\text{CSYNC}}$ represented by NOR gate 16. Transfer of signals throughout the circuit 10 is controlled by a conventional central processing unit (CPU) 15 such as a microprocessor.

Looking now to the adapter 12, its 6-bit output word is directed to a first latching circuit 18 such as a D latch within the apparatus 10. The adapter output word is transferred to the latching circuit 18 on each clock cycle of a pixel clock 20 that clocks the latching circuit, the adapter 12 and the other elements of the apparatus 10. The output word of latching circuit 18 in turn is directed to a second latching circuit 22 and to the first of two sets of inputs to a multiplexer 24. Each set of multiplexer inputs takes a parallel 8-bit input. The least significant four bits of the output word of the first latching circuit 18 are directed to the multiplexer, but the entire 6-bit output word is sent to the second latching circuit 22. The output word of the second latching circuit is also broken into two different-sized portions, with both portions directed to the multiplexer. The least significant four bits of the output word of the second latching circuit 22 are sent to the remaining inputs of the first input set of the multiplexer to complete an 8-bit reformatted output word as the input. The full 6-bit output word of the second latching circuit 22 is directed to the second input set, with the remaining two inputs for second input set provided by a hard-wired ground.

The multiplexer 24 has additional inputs for multiplexing two clock signals and a select signal input for selecting the inputs to be passed through to the multiplexer output. One of the clock inputs takes the clock signal directly from the pixel clock 20 and is selected along with the original 6-bit output word of the latching circuit 18 with the hard-wired ground. The other of the clock inputs takes a clock signal that is first routed through a divide-by-2 element 26 that causes the clock signal to appear only every other clock cycle. This clock input is selected along with the reformatted output word. The output word of the multiplexer 24 is directed to a third latching circuit 28 with the corresponding clock signal. The third latching circuit 28 is clocked via multiplexer 24 every clock cycle if the original output word is selected and every other cycle if the reformatted output word is chosen.

The three latching circuits, appropriately clocked, provide a means for reformatting the output word. The means is best understood by an explanation of the apparatus's operation. On successive clock cycles of pixel clock 20, consecutive adapter output words for adjacent pixels are grouped together as an 8-bit input to the first set of multiplexer inputs. The other set of inputs, on the other hand, receives first one and then the other of the two adapter outputs on the successive clock cycles. The grouping, or "stacking," of consecutive adapter output words increases the number of bits in the adapter output word. The stacked output word provides a higher color resolution because eight bits can address 256 memory locations, each of which stores a unique 16-bit color. Constrast this number with the 16 of 64 colors that can be selected by the EGA. The successive, original adapter output words appearing at the second input set to the multiplexer 24 are not stacked and have the original lower color resolution of the adapter 12. Whichever adapter output word is selected, there is a four-clock cycle delay between the appearance of the output at adapter 12 and reception of the adapter output at the display device 14.

The stacking of outputs to provide high color resolution, however, affects the spatial resolution of the display device 14. With high color resolution selected, the third latching circuit 28 latches the reformatted word at the multiplexer output every other clock cycle. The pixel data addressed by the reformatted word can thus change at only half the original rate. Since the sweep rate of the electron gun within display device 14 does not change, some output words address two consecutive locations and the horizontal resolution is halved. If the original output word is selected, however, the third latching circuit 28 is clocked at the same rate as adapter 12 and a different output word addresses each pixel location. This selection is referred to as the high spatial resolution mode. The selection of the high color and high spatial resolution modes is indicated in FIG. 1 at the clock inputs to the multiplexer 24.

Selection between high color and high spatial resolutions in the present apparatus can be controlled in two ways. The first method is by way of switch commands inserted by a programmer directly into adapter display memory. Referring again to FIG. 1, the 4-bit portion of the output word of the first latching circuit 18 is also routed to detecting means such as a command detector 30 that communicates with the multiplexer 24 through a fourth latching circuit 32. The detector 30 comprises logic gates such as in programmable array logic (PAL) configured to recognize a predefined bit pattern such as a 1111 as the flag for a following switch command. Upon receiving a switch command, the detector 30 clocks the latching circuit 32 to send a 1-bit portion of the command as a select signal to the multiplexer 24 to control the input selection. The multiplexer 24 retains the new selection until another, different switch command is detected that will cause it to switch and select the other input set. Thus, the resolution can be dynamically selected "on the fly" by commands within the display data so that objects in a single display can have different resolutions. For example, text within an image may be displayed with a high spatial resolution for clarity while an associated bar chart may be displayed with high color resolution to illustrate values. This switch command control mode is selected by enabling the detector 30 via an ENBL signal.

Selecting between high color and high spatial resolutions may also be performed through direct program control of latch 32 contents by the CPU 15. This method is enabled whenever detector 30 is disabled via the ENBL signal. Although both resolutions are available, selecting between them "on the fly" is not possible due to the slow nature of the software control exerted by the CPU 15.

The other three bits of the switch command form a portion of the address to a color mapping random access memory (RAM) 34 that contains the pixel color data for driving the display device 14. The 8-bit output word of the third latching circuit 28 forms the other portion of the RAM address. The RAM 34 has 2,048 memory locations of 16 bits each, divided into eight color palettes of 256 memory locations a piece. Colors simulating the original color output of the registers in adapter 12 may be stored in the lower memory locations of one or more of these palettes. In high spatial resolution mode, the original adapter output would therefore be passed through the apparatus 10 without change.

With switch command control enabled, 240 of the memory locations are for colors and are addressed by the stacked output, a significant increase from the 16 simultaneous colors provided by the EGA. The remaining 16 memory locations at 1111xxxx are reserved for the switch commands. The switch commands, of course, do not correspond to a color. Instead, when they are detected, command detector 30 disables clocking of latch 28 via an AND gate 31 so that the color of the pixel previously displayed is replicated. This technique avoids the creation of a pixel-wide border between portions of the displayed image.

The RAM 34 is large enough to accommodate the eight color palettes of 256 memory locations (240 for colors plus 16 for switch commands). The other three bits of the switch command within the display data can then dynamically select which color palette of the eight is active for specific data. The 8-bit output word of the latching circuit 28 selects the color within the palette. Multiple palettes can thus be used within a single displayed image by switching the active palette. If high color resolution mode is used with all eight palettes, up to 1920 colors (240×8) can be simultaneously displayed.

The switch commands that enable the programmer to select dynamically the color resolution and the active palette can be placed anywhere in the display data. It is possible, therefore, to "cut," "paste," and "composite" up to eight individually colored and uniquely shaped objects within a single displayed image. More than eight objects can be displayed, of course, if they share one of the eight available palettes.

Palette switching can be expanded by having the CPU 15 write different palettes into the RAM 34 as is conventionally done in most graphics adapters 12. This method of offering more colors is relatively slow, however, and is usually performed only in cases where the switch commands are not being utilized.

The pixel data of RAM 34 that are addressed by the output of latching circuit 28 are converted into analog color signals by three digital-to-analog converters (DACs) 36. Each of the three 6-bit DACs (red, green, blue) receives five of the sixteen pixel data bits of RAM 34. The remaining data bit drives the common least significant bit of all DACs, yielding 65,536 color possibilities or 64 levels of gray scale. This number of colors sharply contrast with the 64 color possibilities provided by the 6-bit palette registers of the adapter 12. The three color signals are then routed to the analog display device 14 along with the $\overline{\text{CSYNC}}$ and ground signals.

Increasing the Color Resolution

Figure 2:
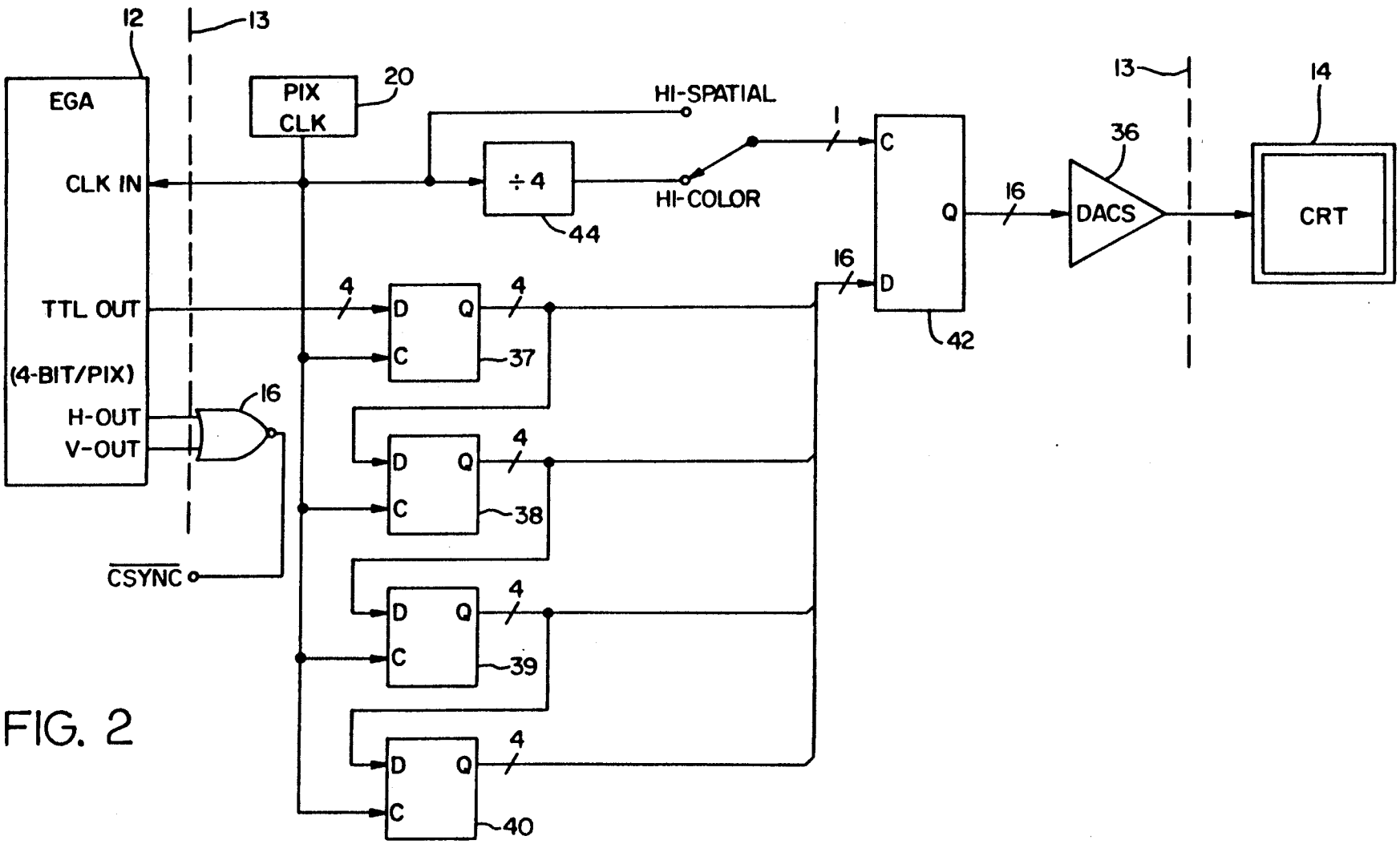
FIG. 2 is a block diagram of a second embodiment of the apparatus for further increasing the color resolution.

The "stacking" of adjacent pixel outputs to increase the color resolution can be extended to provide even higher color resolution if desired. FIG. 2 is a second embodiment of the apparatus, with only the modified portion illustrated for clarity. In place of the latching circuits 18 and 22 are four latching circuits 37–40. Their collective 16-bit output word is routed through an appropriately sized multiplexer (not shown) to a 16-bit latching circuit 42 that functions equivalently to the latching circuit 28 of FIG. 1. The original output word is also routed through this multiplexer, although this routing is not shown in the figure. The divide-by-2 element 26 is replaced by a divide-by-4 element 44 to clock the latching circuit 42 every fourth clock cycle. The color resolution is thus increased from 16 colors to 65,536 colors, a four-thousandfold increase, while the spatial resolution is reduced by a factor of four.

An increase in the adapter output to 16 bits eliminates the need for the RAM 34 and thus the need for switching other palettes into and out of the RAMs to offer more colors, as required in the adapter 12 and apparatus of FIG. 1. The 16-bit output word, in effect, determines the color for the pixel location. By tying the bit positions to the DACs 36 as previously described, all 65,536 colors can be simultaneously displayed in a single displayed image.

Increasing the Spatial Resolution

Figure 3:
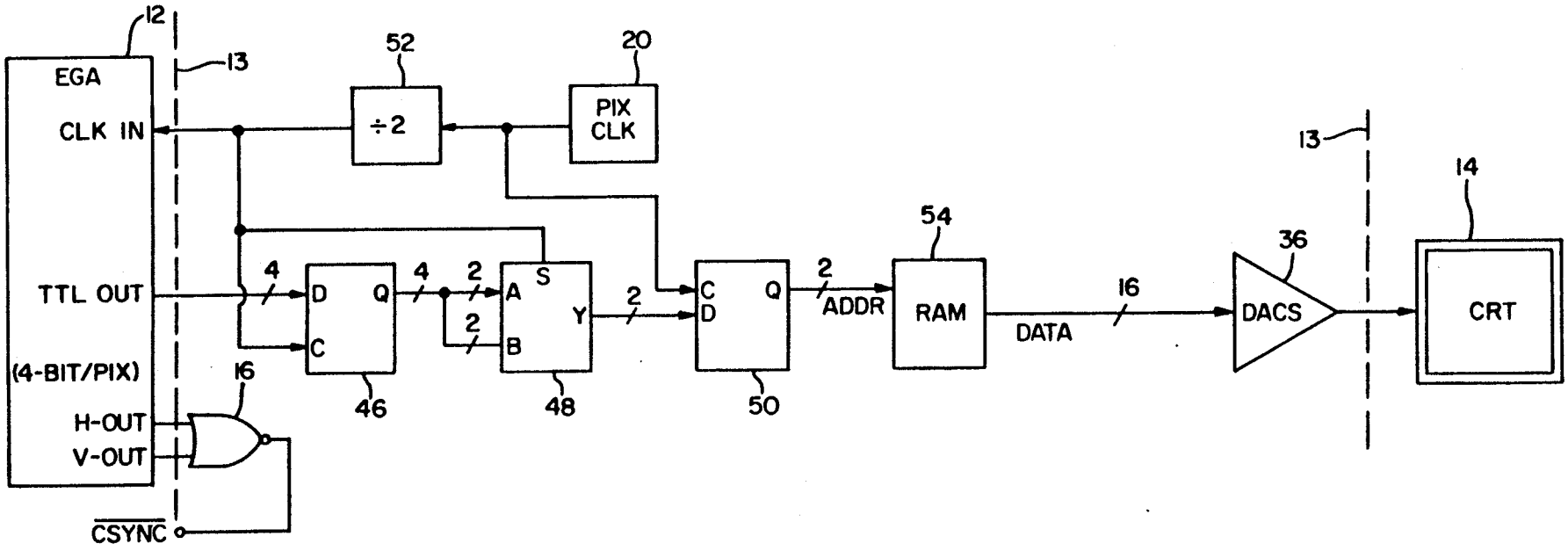
FIG. 3 is a block diagram of a third embodiment of the apparatus illustrating additional elements for increasing the spatial resolution of an existing raster graphics system.

Just as reformatting the adapter output word can increase the original color resolution, it can also be adapted to increase the original spatial resolution. FIG. 3 illustrates how the original adapter output word is reformatted into multiple output words of narrower width. The additional elements within FIG. 3 can be combined with those of FIG. 1 to provide an apparatus that has the capability to increase both the color and spatial resolutions of an existing raster graphics system. For FIG. 3, only the least significant four bits of the original 6-bit word are utilized.

The output word of adapter 12 is latched by a first latching circuit 46, as before. From the latching circuit 46, the adapter output is passed to a multiplexer 48 that divides the output word by alternately selecting 2-bit portions therefrom. The 2-bit reformatted output word of multiplexer 48 is then latched by second latching circuit 50.

The spatial resolution is increased by displaying two different colored pixels in different portions of the original pixel location. The adapter 12, latching circuit 46, and multiplexer 48 are clocked only every other clock cycle, receiving their clock signal from the pixel clock 20 through a divide-by-2 element 52. The second latching circuit 50, on the other hand, is clocked every pixel clock cycle. As a result of this clocking, the original 4-bit adapter output word is divided into two different color signals that are sent to the display device 14 at the original pixel location. The select input of multiplexer 48 is level sensitive. The multiplexer selects its A input as the clock signal rises above the level and the B input as the clock signal falls below the level, so that both 2-bit portions are selected successively in a single clock cycle. The speed of the retracing signals $\overline{CSYNC}$ is also decreased by the slower clock signal, causing two different colors to appear side by side in the pixel original location. The color, however, is now determined by only two bits rather than four and thus color resolution is reduced by a factor of four. But, more importantly, the horizontal spatial resolution is doubled. The output of the latching circuit 50 forms the address to a color map RAM 54 that is configured like RAM 34 but accepts a 4-bit address for the original adapter output as well as the 2-bit reformatted output words. Alternatively, separate memory may be employed for each type of output word.

Having illustrated and described the principles of the invention in a preferred embodiment, it should be apparent to those skilled in the art that the invention can be modified in arrangement and detail without departing from such principles. We claim all modifications coming within the spirit and scope of the following claims.

We claim:

1. In a raster graphics system employing a display device and a graphics adapter for generating an adapter output that provides a bit related number of displayable colors, an apparatus for controlling the color and spatial resolutions of the display device, comprising:

means for reformatting an original output of the graphics adapter into a reformatted adapter output having a different number of bits, one of the original and reformatted adapter outputs having a greater number of bits for providing greater color resolution and the other adapter output having a fewer number of bits for providing greater spatial resolution;

clocking means for providing two clock rates, a faster clock rate for association with the adapter output having the fewer number of bits and a slower clock rate for association with the adapter output having the greater number of bits;

multiplexing means for selecting either the adapter output with the greater number of bits and its associated slower clock rate or the adapter output with the fewer number of bits and its associated faster clock rate; and detecting means responsive to switch commands insertable within the original adapter output for controlling the selection of the multiplexing means, whereby the selected adapter output and clock rate control the color and spatial resolution of the display device.

2. The apparatus of claim 1 in which the reformatting means is adapted to divide the original adapter output into multiple reformatted outputs to increase the spatial resolution.

3. The apparatus of claim 1 in which the reformatting means comprises:

first latching means for latching the original output of the graphics adapter;

a multiplexer for dividing the adapter output latched by the first latching means into multiple portions;

second latching means for latching the multiplexer output; and means for providing a clock signal to cause the first and second latching means and the multiplexer to provide multiple output portions of each original adapter output during a clock signal.

4. The apparatus of claim 1 in which the reformatting means is adapted to group consecutive adapter outputs into a reformatted output to increase the color resolution.

5. The apparatus of claim 1 including color mapping memory means responsive to the detecting means for mapping the output of the multiplexing means to one of a plurality of palettes of simultaneously displayable colors within the memory means, the switch commands directing selection of a palette for the output of the multiplexing means and the detecting means responsive to the switch commands for communicating with the memory means to select the palette.

6. In a raster graphics system employing a display device and a graphics adapter for generating an adapter output that provides a bit related number of displayable colors, an apparatus for controlling the color and spatial resolutions of the display device, comprising:

first latching means for latching an original output of the graphics adapter;

second latching means for latching the output of the first latching means;

clocking means for clocking the graphics adapter and first and second latching means to latch consecutive adapter outputs into the first and second latching means, the output of the first latching means being the original adapter output and the combined outputs of the first and second latching means being a reformatted adapter output, the reformatted adapter output having a different number of bits than said original adapter output; and multiplexing means for selecting between the original adapter output and the reformatted adapter output, whereby the reformatted adapter output provides the display device with greater color resolution and the original adapter output provides greater spatial resolution.

7. In a raster graphics system employing a display device and a graphics adapter for generating an adapter output that provides a bit related number of displayable colors, an apparatus for controlling the color and spatial resolutions of the display device, comprising:

means for providing a clock signal;

first latching means for latching the adapter output of a graphics adapter;

second latching means for latching the output of the first latching means;

multiplexing means for selecting between the adapter output of the first latching means and a reformatted output comprising output of the first and second latching means, the reformatted output having a different number of bits than said adapter output; and third latching means for latching the output of the multiplexing means;

the clocking means adapted to clock the third latching means at a rate slower than the first and second latching means if the reformatted output is selected and at a rate equal to the first latching means if the adapter output is selected.

8. The apparatus of claim 7 in which additional latching means are included for latching the output of the second latching means to produce at the multiplexing means a reformatted output having enough bits to provide a combination for each possible color to be displayed.

9. In a raster graphics system employing a display device and a graphics adapter for generating an adapter output that provides a bit related number of displayable colors, a method for controlling the color and spatial resolutions of the display device, comprising:

reformatting the adapter output from the graphics adapter into a reformatted adapter output having a different number of bits;

associating a faster clock rate with the adapter output having the fewer number of bits and a slower clock rate with the adapter output having the grater number of bits; and selecting either the adapter output and its associated clock rate or the reformatted adapter output and its associated clock rate.

10. The method of claim 9 wherein reformatting the adapter output comprises grouping multiple adjacent adapter outputs together to create a reformatted adapter output with a greater number of bits than the adapter output.

11. The method of claim 9 wherein reformatting the adapter output comprises dividing an adapter output to create multiple reformatted adapter outputs each with a fewer number of bits than the adapter output.

12. The method of claim 9 wherein selecting either the adapter output or reformatted adapter output includes:

selecting the adapter output for one area of the display device; and selecting the reformatted adapter output for another area of the display device, thereby providing a simultaneous display of increased color resolution and increased spatial resolution on the display device.

13. Apparatus for controlling the color and spatial resolutions of a display device that responds to graphics output, comprising:

means for reformatting an original graphics output intended to control the display device into a reformatted output having a different number of bits, one of the original and reformatted graphics outputs having a greater number of bits for providing greater color resolution and the other graphics output having a fewer number of bits for providing greater spatial resolution;

clocking means for providing two clock rates, a faster clock rate for association with the graphics output having the fewer number of bits and a slower clock rate for association with the graphics output having the greater number of bits; and a multiplexer for selecting either the graphics output with the greater number of bits and its associated clock rate or the graphics output with the fewer number of bits and its associated clock rate, whereby the selected graphics output and clock rate control the color and spatial resolution of the display device.

14. The apparatus of claim 13 wherein the reformatting means comprises a reformatting circuit for grouping multiple adjacent original adapter outputs together to create a reformatted adapter output with a greater number of bits than the original adapter output.

15. The apparatus of claim 13 wherein the reformatting means comprises a reformatting circuit for dividing an original adapter output to create multiple reformatted adapter outputs each with a fewer number of bits than the original adapter output.

16. The apparatus of claim 13 wherein the multiplexer is constructed for allowing the selection of the original adapter output for one area of the display device and the reformatted adapter output for another area of the display device, thereby providing for a simultaneous display of increased color resolution and increased spatial resolution on the display device.

17. In a raster graphics system employing a display device and a graphics adapter for generating an adapter output that provides a bit related number of displayable colors, a method for controlling the color and spatial resolutions of the display device, comprising:

providing multiple clock rates;

reformatting at a first clock rate an original adapter output into a reformatted adapter output having a different number of bits than the original adapter output; and clocking the reformatted adapter output to the display device at a second clock rate different than the first clock rate at which the original adapter output is reformatted.

18. The method of claim 17 wherein reformatting the original adapter output comprises grouping multiple adjacent original adapter outputs together to create a reformatted adapter output with a greater number of bits than the original adapter output.

19. The method of claim 17 wherein reformatting the original adapter output comprises dividing an original adapter output to create multiple reformatted adapter outputs each with a fewer number of bits than the original adapter output.

20. The method of claim 17 including:

selecting the original adapter output for one area of the display device; and selecting the reformatted adapter output for another area of the display device, thereby providing a simultaneous display of increased color resolution and increased spatial resolution on the display device.

21. In a raster graphics system employing a display device and a graphics adapter for generating an adapter output that provides a bit related number of displayable colors, apparatus for controlling the color and spatial resolutions of the display device, comprising:

a clock for providing multiple clock rates;

reformatting circuitry for reformatting at a first clock rate an original adapter output into a reformatted adapter output having a different number of bits than the adapter output; and output circuitry for clocking the reformatted adapter output to the display device at a second clock rate different than the first clock rate at which the original adapter output is reformatted.

22. The apparatus of claim 21 wherein the clock provides the first clock rate as its signal rises above and falls below a given signal level.

23. The apparatus of claim 21 wherein the reformatting circuity comprises a latch for grouping multiple adjacent original adapter outputs together to create a reformatted adapter output with a greater number of bits than the original adapter output.

24. The apparatus of claim 21 wherein the reformatting circuitry comprises a multiplexer for dividing an original adapter output to create multiple reformatted adapter outputs each with a fewer number of bits than the original adapter output.

25. The apparatus of claim 21 including a signal input for allowing the selection of the original adapter output for one area of the display device and the reformatted adapter output for another area of the display device, thereby providing for a simultaneous display of increased color resolution and increased spatial resolution on the display device.

* * * * *